US007744013B2

(12) United States Patent
Johnson

(10) Patent No.: US 7,744,013 B2
(45) **Date of Patent: *Jun. 29, 2010**

(54) LAMINAR WATER JET WITH PLIANT MEMBER

(76) Inventor: Bruce Johnson, 6296 NW. 63$^{th}$ Way, Parkland, FL (US) 33067

( * ) Notice: Subject to any disclaimer, the term of this patent is extended or adjusted under 35 U.S.C. 154(b) by 291 days.

This patent is subject to a terminal disclaimer.

(21) Appl. No.: 11/878,913

(22) Filed: Jul. 27, 2007

(65) Prior Publication Data

US 2009/0272825 A1 Nov. 5, 2009

Related U.S. Application Data

(63) Continuation-in-part of application No. 11/280,430, filed on Nov. 17, 2005, now Pat. No. 7,264,176.

(60) Provisional application No. 60/628,226, filed on Nov. 17, 2004, provisional application No. 60/628,227, filed on Nov. 17, 2004.

(51) Int. Cl.

| | |
|---|---|
| ***B05B 17/08*** | (2006.01) |
| ***B05B 17/04*** | (2006.01) |
| ***B05B 1/14*** | (2006.01) |
| ***F21S 8/00*** | (2006.01) |

(52) U.S. Cl. ..... 239/22; 239/12; 239/17; 239/18; 239/23; 239/69; 239/590

(58) Field of Classification Search ..... 239/11, 239/12, 16–18, 22–25, 67, 69, 70, 101, 211, 239/462, 590.3, 591, 602, 590; 40/406; 362/96; 138/26, 30

See application file for complete search history.

(56) References Cited

U.S. PATENT DOCUMENTS 5,160,086 A 11/1992 Kuykendal et al. ..... 239/18

*Primary Examiner*—Darren W Gorman
(74) *Attorney, Agent, or Firm*—Tangent Law Group, PLLC; Eric J. Weierstall, esq.

(57) ABSTRACT

An apparatus having a housing with a water channel, for instance a laminar water flow, flowing there through. A pliant member is provided and contained within at least a portion of the housing with an outer surface and an inner surface, the water channel passing substantially unimpeded along and through the inner surface of the pliant member. An at least one water input, an at least one filter member and an at least one jetting element are also provided. The pliant member is oriented within the housing and surrounds at least a portion of water channel, the portion of the water channel flowing therethrough, and the pliant member expanding to absorb surges within the water channel from the input of water flowing in from the at least one water input.

12 Claims, 2 Drawing Sheets

LAMINAR WATER JET WITH PLIANT MEMBER

CROSS REFERENCE TO RELATED APPLICATIONS

This application claims benefit of the earlier filed U.S. Provisional Applications Nos. 60/628,226 and 60/628,227 both filed Nov. 17, 2004, and is a continuation-in-part of U.S. Utility application Ser. No. 11/280,430, filed Nov. 17, 2005, now U.S. Pat. No. 7,264,176 all of which are incorporated herein by reference.

FIELD OF THE INVENTION

The invention relates to a water feature, specifically a laminar flow water jet with a pliant member.

BACKGROUND OF THE INVENTION

It is often desired to utilize a fluid, such as water, as part of a display or attraction. Increasingly, the popularity of using water attractions as an integral part of domestic and commercial landscaping has moved architects and landscapers to push further and further into incorporating the decorative aspects of these water features into new building and sites. These features are incorporated through swimming pools, spas, ponds, lakes and other water features and sources found in the typical property. Various types of fountains adorn public and private plazas, parks, advertisements, and amusement parks.

To this end, recent interest and developments have been made in producing smooth, laminar flows of water which give the appearance of a solid glass or clear plastic rod in various water attractions, for instance, the fountain presentation in the Bellagio Hotel in Las Vegas or the Dancing Frogs attraction at the EPCOT center of Disney World, as described in U.S. Pat. No. 5,078,320 to Fuller, et al. These attractions incorporate laminar flow water jets. These devices jet water like a fountain, but the water has a minimum of turbulence in it, that is the water is predominantly laminar. This results in the smooth rod structure of the streams that are issued from the jets.

These devices have used a wide variety of elements to instill laminarity into the water flow. Various attempts have been made at reducing laminarity with a variety of elements in a water stream. For example, U.S. Pat. No. 4,393,991 to Jeffras et al. discloses a water nozzle which utilizes an elongated conical nozzle which includes fin-like members to reduce the turbulence of the water and to produce a laminar flow in the water. U.S. Pat. No. 3,321,140 to Parkison et al. discloses an attachment for a faucet which utilizes a series of fins in a cylindrical nozzle for producing a laminar flow of water to reduce the splash on the bottom of a sink or tub. U.S. Pat. No. 3,730,440 to Parkison teaches a laminar flow spout which utilizes a plurality of independent nozzles arranged within the single spout which results in a plurality of streams having laminar flow characteristics.

Other methods which have been utilized to obtain laminar flow of fluids include the use of curved perforated disks inserted in the jet to produce a splashless laminar output, such as in U.S. Pat. No. 3,851,825 to Parkison et al; U.S. Pat. No. 3,630,444 to Nelson; and, U.S. Pat. No. 3,730,439 to Parkison. In U.S. Pat. No. 4,119,276 to Nel, for instance, a plurality of straight, perforated screens having varying degrees of perforation are utilized to provide a splash free, clear, laminar output. Further variations in the designs of the screened or filtered embodiments provide for foam screening filters. For instance, U.S. Pat. No. 4,795,092 to Fuller; U.S. Pat. No. 4,889,283 to Fuller et al.; and U.S. Pat. No. 5,213,260 to Tonkinson show closed cell foam screens or filters, similar in positioning and function to the screens shown in the previously discussed devices. The overarching goal of these screens is to reduce turbulence in the movement of water stream within the water jet. However other sources of turbulence exist beyond the simple flow of the water.

For instance, another significant source of turbulence in the water stream occurs from pump surges and overpressures associated with variations in pump operation. Several design features have been attempted to mitigate such variations. For instance, some designs feature a first outer chamber for initial input of water which slows the water and accommodates surges. Air pockets are also often provided within a housing to accommodate any overpressures and reduce the turbulence. For example, in U.S. Pat. No. 5,641,120 to Kuykendal et al., the water is first passed into an outer chamber then passed radially into a second chamber. Within the second chamber the water is filtered through a series of screens/baffles to reduce turbulence and improve laminarity prior to being ejected from a nozzle to produce a laminar jet. The system accommodates pump surges and pressure variations by using a larger, more complex housing comprising of a first and second chamber. This adds costs and complexity to the system and requires a larger footprint, potentially limiting the application of the device in some landscape situations.

Similarly, various attempts have been made to provide surge suppressors in pipes and piping systems. For instance, U.S. Pat. No. 2,495,693 to Byrd, et al.; U.S. Pat. No. 3,473,565 to Blendermann; U.S. Pat. No. 5,718,952 to Zimmerman, et al.; and U.S. Pat. No. 6,390,131 to Kilgore show surge suppressors used in piping systems. U.S. Pat. No. 4,732,175 to Pareja shows a surge suppressor including a rigid outer housing and a tubular diaphragm member placed coaxially within a rigid outer housing. The member is made of a suitable elastomeric material having predetermined durometer and elastic properties.

However, unlike these piping systems, in a laminar flow water jet besides mitigating pressure variations and pump surges, the goal is to reduce the turbulence in the water. Placing a surge suppressor like this in the line prior to the body of the laminar flow water jet may help to accommodate some of the turbulence and overpressure associated with a surge, but this is minimal due to the limitations in the degree of change in the narrow volume of the hose relative to the total volume of water passing through the jet. Furthermore, with the distance between the surge suppression device in a hose and the point at which the flow enters a jet, the suppression device may introduce further turbulence immediately prior to the intake as there is significant axial and/or radial motion in the velocity profile at the water intake due to the variation of the hose volume. In fact, depending on the elastomeric properties, the deflection of the water flow within the surge suppressor may even attenuate these turbulences. As a result, eddies and turbulences may be carried through the jet and result in an output which includes undulations, splashing, and ripples.

As an example, U.S. Pat. No. 5,160,086 to Kuykendal et al. incorporates a surge suppression device in the input hose of a laminar flow water jet system. It describes a lighted laminar flow nozzle with a resilient hose and a bladder. As discussed above, due to the placement and distance of the resilient bladder from the inner housing, it does not allow for adequate laminarity to develop in the flow. Therefore, the design incorporates a diffuser element, a first and second chamber, a series of screens, and an air pocket to mitigate the inability of the bladder alone to both accommodate the pump surges and provide additional laminarity in the flow. This increases the cost, complexity, and size of the resulting device.

Although these prior methods are useful in reducing the amount of turbulence in streams of water and accommodating pump surges, none of the methods or devices to date is suitable in providing a laminar flow water jet with a single chamber, with improved laminarity and reduced size, wherein substantially all of the turbulence is eliminated from a columnar stream of water as it exits the water jet. Thus, there exists a need to provide a laminar flow water jet with the ability to adequately accommodate pump surges and pressure variations while providing for improved laminarity within the device and simultaneously minimizing the overall size and complexity of the device to reduce costs and improve flexibility for landscaping by reducing the overall footprint of the device.

SUMMARY OF THE INVENTION

An object of the invention is to provide a laminar flow water jet with improved capabilities in handling pump surges and pressure variations.

A further object of the invention is to provide a laminar flow water jet that is more compact and cost effective.

A still further object of the invention is to provide a laminar flow water jet that is able to simultaneously accommodate pump surges and improve the laminar flow of water within the laminar flow water jet.

Yet another object of the invention is to provide a water jet with a pulsed laminar flow column through a controller element that inputs an energetic wave into the laminar flow to disrupt and columnarize the flow.

The invention includes an apparatus and a method of operation.

The apparatus of the invention includes a housing with a water channel flowing there through with a pliant member, an at least one water input, an at least one filter member and an at least one jetting element. The pliant member is oriented within the housing and surrounds at least a portion of the water channel, the portion of water channel flowing therethrough and the pliant member expanding to absorb surges from the input of water flowing in from the at least one water input. The pliant member can surround the water channel within the housing. The pliant member can also be located on an at least one filter member or element.

The apparatus can have further include an at least one lighting element. The at least one lighting element can be an at least one lighting tube and an at least one light source. The apparatus may also have an at least one baffle member.

The apparatus may additionally provide a controller. The controller can have a variable timed input generating an energy pulse wave that enters the water channel and interrupts the laminar flow in the water channel. The pliant member can be comprised of at least one of an at least one closed cell foam material, a rubber compound, a PVC and rubber compound, air pillows, gel filled members, and foam. The pliant member can also be a tubular structure surrounding the water channel oriented in and coextensive with the housing.

The apparatus can also provide an at least one baffle member. The lighting element can also be a lighting system and the lighting system can be at least one of an at least one conventional incandescent, halogen, fiber optic, or LED lighting system and a corresponding focusing element.

The apparatus of the invention also includes a laminar flow water jet providing a housing having a water channel, a pliant member contained within at least a portion of the housing with an outer surface and an inner surface with the water channel passing substantially unimpeded along and through the inner surface of the pliant member, an at least one water input admitting water into the water channel, a pliant member located within the housing and surrounding the water channel, an at least one filter member contained within the housing and interspaced within the water channel, and an at least one jet outlet, wherein water enters through the at least one water input and the water is made laminar with the pliant member being oriented within the housing and around the water channel and expanding to absorb surges from the input of water flowing in from the at least one water input while adding to the laminarity of the laminar water flow as it is passed through the housing to the jet outlet and ejected as a tube of laminar water.

The water admitted into the water channel can have a direction of flow and the pliant member can surround the water channel in the direction of flow. An at least one lighting element can also be provided. The at least one lighting element further comprises a lighting tube and an at least one light source. The lighting source can be an at least one light emitting diode.

An interior can be provided and can be defined by an at least one wall of the housing member and the pliant member can abut at least one of the at least one wall of the interior of the housing. An at least one baffle member can also be provided. The at least one water input can be a plurality of water inputs. The plurality of water inputs can be two water inputs. One input can be male threaded and the other female threaded. A coupling element can be provided for connecting the two water inputs to test for water soundness.

The apparatus of the invention also includes a laminar flow water jet providing a housing having a water channel, an at least one water input admitting water into the water channel, an at least one filter member contained within the housing and interspaced within the water channel, a pliant member contained within at least a portion of the housing with an outer surface and an inner surface, the water channel passing substantially unimpeded along and through the inner surface of the pliant member and an at least one jet outlet, wherein water enters through the at least one water input and the water is made laminar with the pliant member being oriented within the housing and around the water channel and expanding to absorb surges from the input of water flowing in from the at least one water input while adding to the laminarity of the water in the water channel as it is passed through the housing to the jet outlet and ejected as a tube of laminar water.

The method of the invention includes a method for improving laminarity in a water channel including the method steps of pumping a water channel through a water input with a direction of flow, admitting the water channel into a housing, passing the water channel along a pliant member, the pliant member having an outer surface and an inner surface, the water channel passing within and along the inner surface of the pliant member and the pliant member being oriented in the direction of flow of the water channel to expand and absorb pressure variations and to aid in making the water laminar in the water channel, and jetting the water channel from the housing.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the drawings, where the same reference numerals refer to the same features.

DETAILED DESCRIPTION OF THE INVENTION

Figure 1:
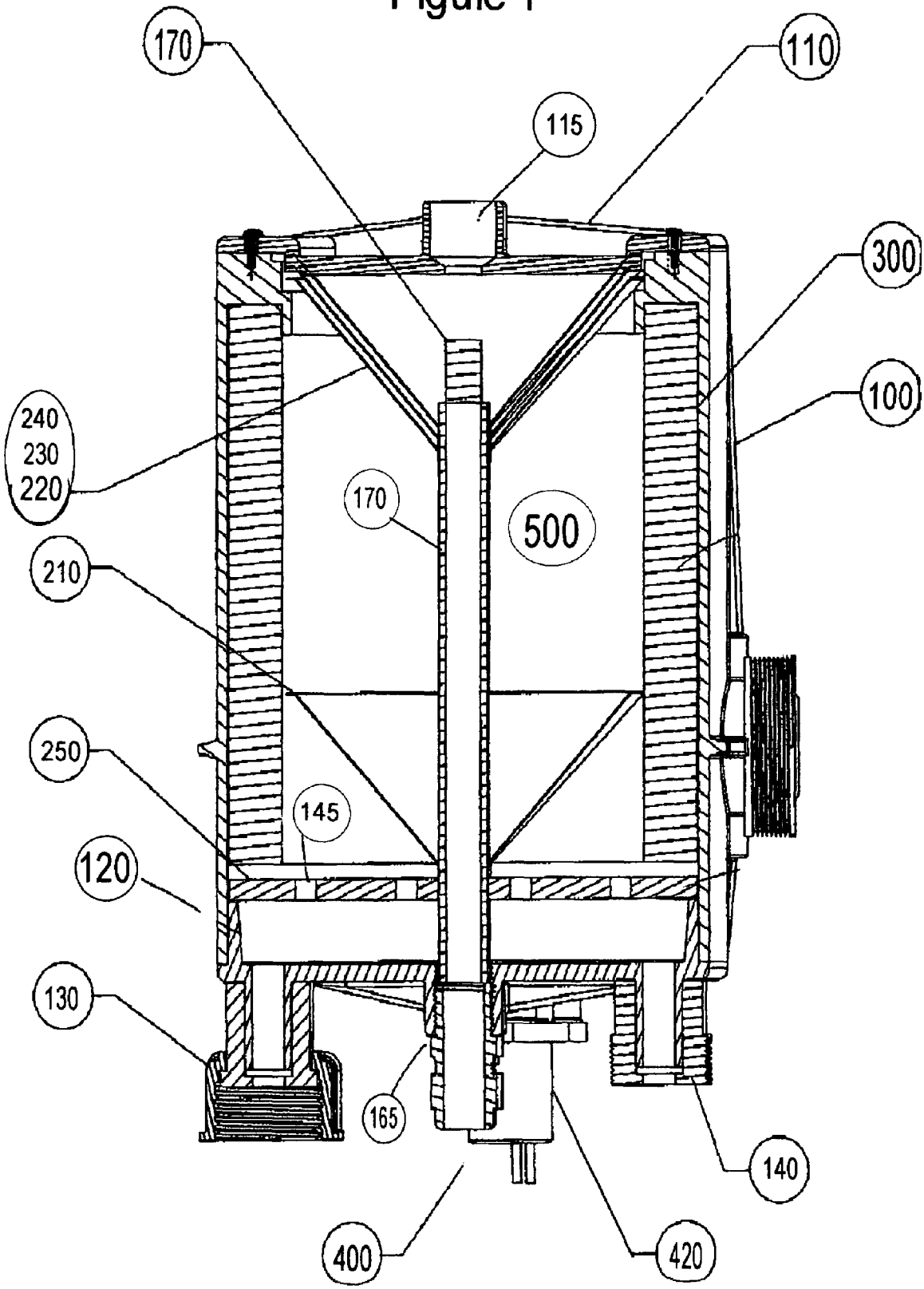
FIG. 1 shows a cross-sectional view of an exemplary embodiment of the instant invention.

FIG. 1 shows a cross sectional view of the exemplary embodiment of the instant invention. The exemplary embodiment comprises a housing 100, a housing top 110 with an at least one jet outlet 115 extending there through, and a housing base 120. Flowing into the housing base 120 is an at least one water input, in this instance a first water input 130 and a second water input 140. Within the housing 100 a laminar water flow channel 500 resides. Additionally, a lighting orifice 165 is provided and passes through the base plate to couple to a lighting tube 170. The lighting tube 170 extends into the laminar water flow channel 500 and through the housing 100 toward the at least one jet outlet 115. The lighting tube 170 is provided to apply lighting effects to the exiting water. The tube may utilize any appropriate lighting system, including but not limited to, conventional incandescent, halogen, fiber optic, LED, nano scale lighting devices or similar lighting systems. Furthermore, although the exemplary embodiment utilizes a light tube, any appropriate manner of focusing the lighting system or focusing elements may be used to illuminate the exiting water jet.

In the exemplary embodiment shown, internal to the housing 100 and the laminar water flow channel 500 flows from the plurality of inputs 130, 140, into an at least one baffle member 250 with a plurality of orifices 145 situated therein. Alternatively, the baffle member may be omitted from further exemplary embodiments. Above the plurality of inputs 130, 140 shown, an at least one filter member, in this case a plurality of screens, is provided.

A first filter member 210 is provided in the laminar water flow channel 500 of the exemplary embodiment show in approximately the middle of the housing chamber. Variations in the placement, the positioning, the spacing, the shape, the size, and the number of members or screens can be provided alone or in conjunction with variations in sizes, density, construction, shapes, mesh size, screen gauge, and other variables to suit the particular design constraints of a further exemplary embodiment without departing from the spirit of the invention. Surrounding the interior of the housing 100 is an at least one elastomeric or pliant member 300 through which the laminar water flow channel 500 passes.

Pliant member 300 can be comprised of, for example, closed cell foam, rubber compounds, PVC and rubber compounds, air pillows, gel filled members, foam, or similar pliant materials. Pliant member 300 aids in damping vibrations within the water as it passes through the laminar water flow channel 500. Particularly pliant member 300 aids in mitigating pump surges and similar pressure variances as well as aiding in improving the laminarity in the water flow. In the exemplary embodiment shown this is accomplished through the compression of the pliant member 300 outwardly, as the surge temporarily increases the volume of water within the housing 100. In this fashion, the compression of the pliant member 300 slightly increases the volume of the housing 100 to accommodate the surge. The pliant member 300, in the exemplary embodiment, expands and allows or accommodates the higher volume of water to pass through with a minimum disturbance and without obstruction of the laminar water flow channel 500. In addition, the pliant member 300 may provide a cellular structure to aid in slowing and, thereby, increasing the laminarity in the laminar water flow channel 500. The at least one pliant member 300 may also be incorporated, in combination with the pliant member shown around the housing or alone, into an at least one of the at least one filter members.

In the exemplary embodiment shown, in addition to the first filter 210 the at least one filter member includes a further series of three filter members 220, 230, 240 above the first filter member 210, which helps provide additional laminarity to the water as it flows towards the at least one jet outlet 115. The additional filter members 220, 230, 240 are also shown as conical in shape. However, it should be understood by one of ordinary skill in the art that the variations in geometry, number, and placement/spacing of the filter members are within the spirit of the invention. Additionally, as mentioned the at least one pliant member 300 can include an at least one pliant member mounted on, between, or within an at least one of the at least one filter members.

In addition to the laminar flow jet 10, a control package 400 is provided on the exterior of the housing 100. As depicted in the exemplary embodiment the control package 400 is provided as a microprocessor controller 410 and a solenoid 420. The control package 400 provides a variable timed input to produce a controlled pressure variance or pulse wave within the laminar water flow channel 500.

This can be accomplished in any number of ways, in the exemplary embodiment, the solenoid 420 "thumps" or mechanically strikes the sides of the housing to produce the pressure wave within the laminar water flow channel 500. This is done in the exemplary embodiment shown by the solenoid 420 striking the exterior of the housing 100. Additional methods of providing the control variable pulse within the water flow may be utilized, for example the components of the package can be made to include digital electronic, analog electronic, electro-mechanical, or mechanical components suitable for producing a controlled input, such as a mechanical striking mechanism with a motor and clocks, an inline water wheel that driven by the incoming water flow, a return drip system that strikes the laminar water flow channel, sonic devices, electromechanical striking devices and similar components that can provide a metered pulse wave to interrupt the laminar jet. The control package 400 can comprise additional components and may alternatively be comprised of all solid state components, all electrical components, or any suitable combination therein to provide the necessary resonance or "thump" to create the pressure wave on or in the laminar water flow channel 500.

In the exemplary embodiment, the solenoid 420 is controlled by the microprocessor 410 and may be timed to suit a desired application. For instance, the microprocessor 410 may time the impulse from the solenoid 420 to music. Additionally, the controller 400 may be controlled by a master controller (not shown) that controls additional features or accessories. The controller may also include a wireless controller or master controller. The controller, through the pulse wave, interrupts the laminar tube of the laminar water jet, producing a segmented laminar water jet. The timing of the pulses and the length of the jet can thus be controlled to provide a wide number of variations in the shape and size of the laminar jets. Additionally, the interruptions in the laminar water tube issuing from the jet can result in a pleasing multi-colored water effect.

Figure 2:
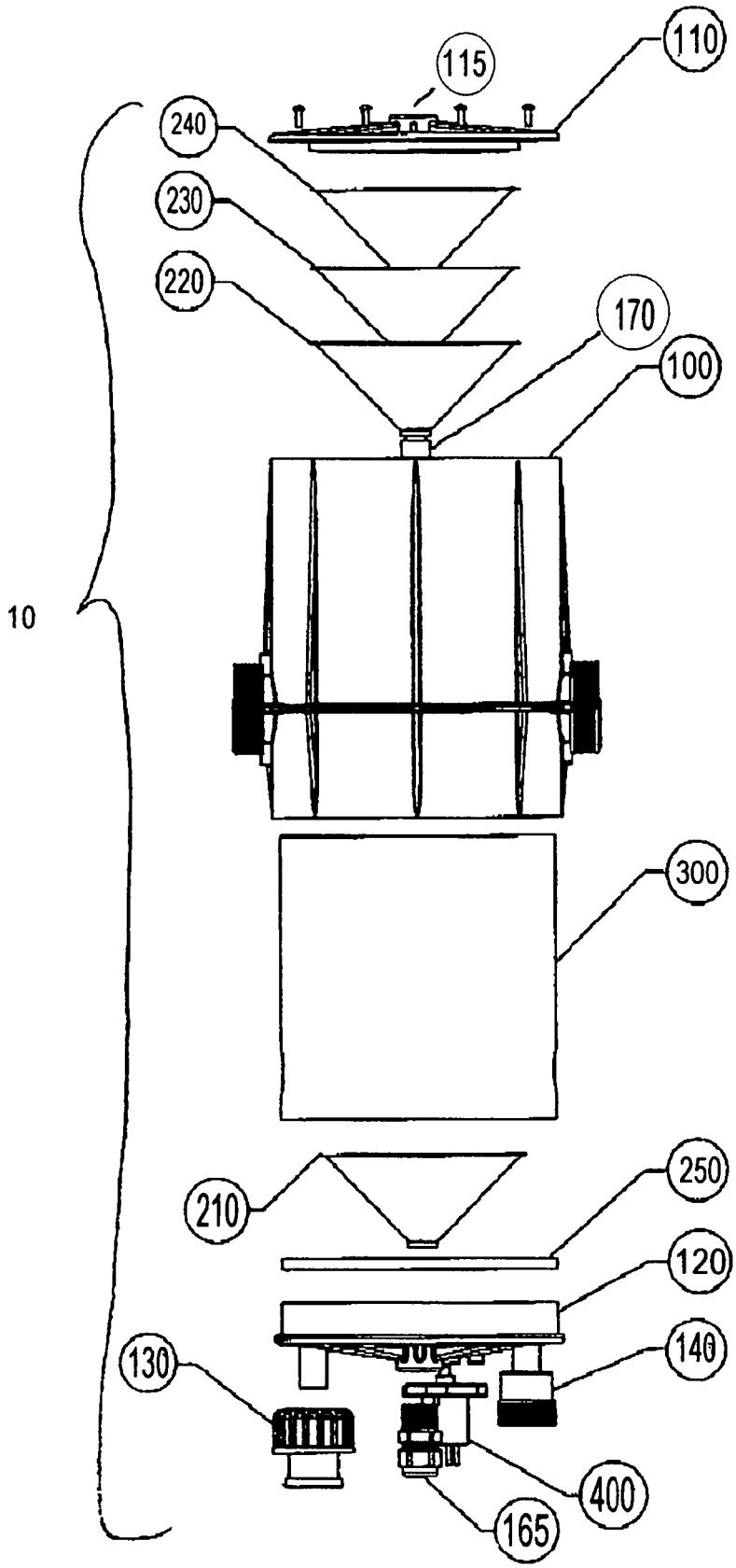
FIG. 2 shows an exploded view of an exemplary embodiment of the instant invention.

FIG. 2 shows an exploded view of the embodiment of FIG. 1. Again within housing 100, of the laminar jet 10, the housing top 110 is provided with a jet 115 protruding there through. Housing base 120 is provided with a common water inlet chamber 130 fed by an at least one water inlet, in the exemplary embodiment shown a first water inlet 130 and second water inlet 140. First water inlet 130 should be noted as having male threads. Second water inlet 140 should be noted as having female threads.

The provision of two water inlets, in this case a first inlet having male threads 130 and a second inlet having female threads 140 allows for easy testing of water tightness within each laminar water jet 10 produced. Additional inlets may be provided without departing from the spirit of the invention. Further additional pairs of matched male/female inlets can be provided while providing the same ease of maintenance. During maintenance for water soundness testing of the exemplary embodiment the provision of both male and female inlets in the laminar water jet 10 allows for easier maintenance testing by coupling one inlet to the other and filling the device. The water turbulence is also initially reduced by the division of the at least one water inlet into two water inlets 130, 140, which pass through to the baffled common water chamber 130 after passing through the baffle orifices 145 the water passes through the first filter member 210 and is moved along the laminar water flow channel 500.

Above the common water chamber 130 and through the orifices provided in the baffle member 250 the laminar flow channel 500 is provided where in water moves from the inlet side to the nozzle jet 115, increasing in laminarity as it travels. Surrounding the laminar water flow channel 500 is pliant member 300 in the exemplary embodiment shown in FIG. 2 the pliant member may for instance comprise a layer of ENSOLYTE, a PVC and rubber compound available commercially under this trade name. As the water passes through the laminar water flow channel 500 it is also passed through the at least one filter member, here a first filter screen 210 to initially reduce turbulence within the water with second, third and fourth filter members 220, 230, 240 provided for further smoothing of the water between the additional filter members. This allows for a further reduction in turbulent flow within laminar water flow channel 500 and thereby increases laminarity prior to ejecting the laminar water tube through the jet outlet 115.

The water is then jetted out of the laminar jet outlet 115 as a laminar tube. The control package 400, as previously discussed, can provide a periodic protuberance within the water channel. These periodic protuberances interrupt the laminarity of the water tube as it exits the laminar water channel 500 at the jet outlet 115. This produces breaks within the laminar out flow or laminar tube or column of water. In addition to the visual effect of breaking the laminar flow tube that is ejected, these breaks in the laminar flow tube provide a particularly desirable effect when combined with the lighting from lighting tube 170. The lighting tube 170 provides for illumination of the laminar flow tube as it is ejected. As the protuberance is generated within the laminar flow tube, it is possible to break the light effect within the tube into a variety of colors. Thus, the lighting and lighting changes within the lighting tube 170 are coordinated with the controller 400 to provide a multi-color laminar water jet.

The embodiments, exemplary embodiments, and examples discussed herein are non-limiting examples of the invention and its components. The invention is described in detail with respect to exemplary embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. An apparatus comprising:

a housing with a water channel flowing therethrough;

a pliant member;

an at least one water input;

an at least one filter member; and an at least one jetting element, wherein the pliant member is oriented within the housing and surrounds at least a portion of the water channel, the portion of the water channel flowing therethrough, and the pliant member expanding to absorb surges within the water channel from the input of water flowing in from the at least one water input.

2. The apparatus of claim 1, further comprising an at least one lighting element.

3. The apparatus of claim 1, further comprising an at least one baffle member.

4. The apparatus of claim 1, further comprising a controller.

5. The apparatus of claim 4, wherein the controller further comprises a control input, the control input triggering the generation of an energy pulse wave that enters the water channel and interrupts a laminar flow in the water channel.

6. The apparatus of claim 1, wherein the pliant member is comprised of at least one of an at least one closed cell foam material, a rubber compound, a PVC and rubber compound, air pillows, gel filled members, and foam.

7. A laminar flow water jet, comprising:

a housing;

an at least one water input admitting water into a water channel;

a pliant member contained within at least a portion of the housing with an outer surface and an inner surface, the water channel passing substantially unimpeded along and through the inner surface of the pliant member;

an at least one filter member; and an at least one jetting element, wherein water enters through the at least one water input and the water is made laminar with the pliant member being oriented within the housing and around the water channel and expanding to absorb surges from the input of water flowing in from the at least one water input while adding to the laminarity of the water in the water channel as it is passed through the housing to the jet outlet and ejected as a tube of laminar water.

8. The laminar flow water jet of claim 7, further comprising an at least one lighting element.

9. The laminar flow water jet of claim 7, further comprising an at least one baffle member.

10. The laminar flow water jet of claim 7, wherein the pliant member is comprised of at least one of an at least one closed cell foam material, a rubber compound, a PVC and rubber compound, air pillows, gel filled members, and foam.

11. A method for improving laminarity in a water channel, comprising the method steps of:

pumping a water channel through a water input with a direction of flow; admitting the water channel into a housing;

passing the water channel along a pliant member, the pliant member being a tubular structure surrounding the water channel oriented in and coextensive with the housing and having an outer surface and an inner surface, the water channel passing within and along the inner surface of the pliant member and the pliant member being oriented in the direction of flow of the water channel to expand and absorb pressure variations and to aid in making the water laminar in the water channel; and jetting the water channel from the housing.

12. The method of claim 11, further comprising the method step of smoothing the water within the water channel passing it over an at least one of an at least one baffle member and an at least one filter member to further impart laminarity within the water channel.

* * * * *